United States Patent [19]

Brachert et al.

[11] 4,453,860

[45] Jun. 12, 1984

[54] FIREDAMP-SAFE METHOD FOR STUD DRIVING CARTRIDGES

[75] Inventors: Heinrich Brachert, Troisdorf; Axel Homburg, Bergisch-Gladbach, both of Fed. Rep. of Germany

[73] Assignee: Dynamit Nobel Aktiengesellschaft, Troisdorf, Fed. Rep. of Germany

[21] Appl. No.: 376,797

[22] Filed: May 10, 1982

Related U.S. Application Data

[63] Continuation of Ser. No. 145,655, May 2, 1980, abandoned, which is a continuation of Ser. No. 855,134, Mar. 2, 1978, abandoned.

[30] Foreign Application Priority Data

Mar. 2, 1977 [DE] Fed. Rep. of Germany ..... 2709037

[51] Int. Cl.[3] ..... E21D 20/00

[52] U.S. Cl. ..... 405/259; 102/290; 102/531; 149/11; 227/9

[58] Field of Search ..... 102/290, 531; 149/19.6, 149/11; 405/259; 227/9

[56] References Cited

U.S. PATENT DOCUMENTS

| | | | |
|---|---|---|---|
| 2,858,289 | 10/1958 | Bohn et al. | 102/103 |
| 3,014,427 | 12/1961 | Scurlock | 102/103 |
| 3,046,829 | 7/1962 | Roemer | 102/103 |
| 3,055,781 | 9/1962 | Yamamoto | 149/19.6 |
| 3,166,896 | 1/1965 | Breitengross et al. | 102/103 |
| 3,577,921 | 5/1971 | Van Langenhoven | 102/38 |
| 3,927,616 | 12/1975 | Axelrod et al. | 102/DIG. 1 |
| 3,999,382 | 12/1976 | Clifford et al. | 102/103 |
| 4,026,212 | 5/1977 | Dardick | 102/531 |
| 4,106,960 | 8/1978 | Brachert et al. | 149/11 |
| 4,115,999 | 9/1978 | Diebold | 102/103 |
| 4,128,996 | 12/1978 | Garner et al. | 149/19.6 |

OTHER PUBLICATIONS

Meyer, "Explosives", pp. 209–213, Verlag Chemi., (1977), New York.

*Primary Examiner*—Edward A. Miller

*Attorney, Agent, or Firm*—Sprung, Horn, Kramer & Woods

[57] ABSTRACT

A firedamp-safe propellant charge comprising a pyrotechnical gas-yielding propellant, said propellant coated with a polymer and/or amides of $C_2$–$C_4$ dicarboxylic acids and/or ammonium oxalate, which composition, upon ignition of the propellant, disintegrates into radicals, said coating being present on said popellant in an amount of 15 to 30 weight percent based upon the weight of said propellant charge.

17 Claims, No Drawings

FIREDAMP-SAFE METHOD FOR STUD DRIVING CARTRIDGES

This is a continuation of application Ser. No. 145,655, filed May 2, 1980, now abandoned, which is a continuation of Ser. No. 855,134 filed Mar. 2, 1978, now abandoned.

BACKGROUND OF THE INVENTION

1. Field of the Invention

This invention relates to a firedamp-safe propellant charge. More especially, this invention relates to a coated propellant charge which is firedamp-safe. This invention is particularly concerned with firedamp-safe propellant charges employed in connection with stud driving cartridges. These propellant charges are therefore operable to drive studs in mines and the like where otherwise there would be fire and/or explosion hazards. With the propellant charges of the invention, for the first time, stud setting machines equipped with propellant charges can be used in coal mining operations.

2. Discussion of the Prior Art

Stud setting machines operate by firing a propellant cartridge in a cartridge chamber. The energy thus liberated drives a piston or plunger, to the front end of which a steel stud is fastened in a socket. This stud is then driven with great force into iron, concrete, masonry or other building materials. Lastly, the excess pressure of the propellant gases is released through a relief aperture.

In mining opeations it has not been possible hitherto to use stud setting machines in atmosphere containing firedamp. Propellant cartridges for these machines contain as propellants either pyrotechnical mixtures or a powder charge which releases the energy and converts it to power in the machine. To produce this power, the explosion heat or the combustion energy of the propellant must be proportionately high. It follows that the explosion temperature must also be high. This explosion temperature, however, is so high that the release of power is regularly accompanied by fire or flash. Even if the flash is externally invisible and the gases are greatly cooled by carrying them through a labyrinth until they emerge into the open, it must be anticipated, in the case of a normal machine, that firedamp gases will penetrate into the machine and can there be ignited. In other words, the ignition of an explosive gas mixture must be anticipated.

The tendency towards firedamp ignition can be simulated by the following experiment: a propellant cartridge is fired in a firing device other than a stud setter into an explosive gas atmosphere which is contained, for example, in a thin gas balloon placed in front of the cartridge. The gas atmosphere is regularly ignited when the propellants known hitherto are fired.

The possibilities of improving the propellant charges such that ignition will be prevented are very slight. The space available in the charge chamber of the cartridge is limited. In addition, charges which are commonly used to conceal muzzle flash cannot be used because they will too quickly foul the machine.

The reduction of the specific energy of the charge and with it the explosion temperature either by changing the charge components or by the admixture of energy reducing substances will not bring the desired success, because then the necessary power is not achieved, which is expressed, for example, as the dynamic liveliness:

$$\frac{dp/dt}{p_{max}}$$

Thus, it is no longer possible for a rapidly effective thrust to develop. This is because an only slightly extended burn time reduces the acceleration of the stud to such an extent that it is no longer driven into the building material.

It is an object of this invention, therefore, to provide a propellant charge for a cartridge of a stud setting machine which does not cause ignition of firedamp mixtures. More especially, it is an object of this invention to provide such a propellant charge which, while preventing ignition of a firedamp mixture, retains sufficient power to effect setting of the stud. It is a further object of this invention to provide a coated propellant charge which, when employed in a stud setting machine, inserts a stud in a coal mine without effecting ignition of a firedamp mixture therein.

SUMMARY OF THE INVENTION

In accordance with this invention there is provided a firedamp-safe propellant charge comprising a pyrotechnical gas yielding propellant, said propellant coated with a polymer and/or amides of $C_2$–$C_4$ carboxylic acids and/or ammonium oxalate, which composition, upon ignition of said propellant, disintegrates into radicals, said coating being present on said propellant in an amount of 15 to 30 weight percent, based upon the weight of said propellant charge.

In accordance with this invention it has been found that certain polymers are effective coatings for propellant charges in preventing the ignition of firedamp mixtures when the propellant charges are fired in a coal mine or the like. Specifically, in accordance with this invention pyrotechnical gas yielding propellants are coated with polymers which disintegrate into radicals. Polymers which disintegrate into radicals are those polymers which, when heated, split off short chained radical fragments at the molecule ends. These polymers include polymers such as polyhydroxymethylene compounds or the polymerization products of acrylic acid or of acrylic acid esters which can be alkyl-substituted if desired. These polymers generally have a molecular weight between 1000 and 150,000 preferably between 1200 and 100,000 the molecular weight being determined in accordance with gel chromatography [gpc-method].

Examples of these compounds are trioxane, polyformals, polyacetals, polyacrylates or poylmethacrylates. The ester component of the acrylic acid ester can have 1 to 4 carbon atoms. Preferably it has 1 to 2 carbon atoms. Other compounds which are useful as coatings, and break down into radicals are amides of $C_2$–$C_4$ dicarboxylic acids, especially $C_2$–$C_4$ aliphatic dicarboxylic acids. Particular compounds are amides of oxalic acid, malonic acid, succinic acid, tartaric acid of maleic acid.

The third type of compound contemplated is ammonium oxalate.

The coating of the invention can be either over the entire surface or over only a portion of the surface of the propellant. If only a portion of the surface is covered by it, it is desirable to apply the coating to the end facing the crimp of the cartridge.

It is desirable that the coating be in the form of a coherent film on the surface of the charge. In this case, the polyacrylates or polymethacrylates can be used as the film formers. They are made into a lacquer, using aromatics preferably as solvents, such as toluene or the xylenes, acetic ester, or acetone. The polymethylene compounds and/or the above-named acid amides, for example, can also be dispersed in this acrylic resin lacquer.

If the coating is not to contain any acrylic resins, then the polyhydroxymethylene compounds and/or the above-named acid amides and/or oxalates can also be dispersed or dissolved in any other lacquer and can be applied in this manner as a coating on the charge. The charges which are coated in accordance with the invention are known propellant charges. They are composed either on the basis of nitrocellulose or on the basis of pyrotechnical mixtures.

The nitrocellulose propellants can be monobasic or dibasic propellants. The former are preferably used in the form of cord powder, and the latter preferably as rolled ball powder. Pyrotechnical mixtures used as propellants for stud setting machines are described for example, in German Pat. No. 18 06 550 and U.S. Pat. Nos. 3,468,930 and 3,719,604, the disclosures of which are hereby incorporated herein by reference.

The application of the coatings to the propellant charges is performed by known methods. The non-film-forming substances are best dispersed in a lacquer, preferably an acrylic resin lacquer. Then this lacquer is applied to the propellant charge and then the solvent is evaporated. It is also possible to disperse the claimed substances in another binding agent and apply this dispersion to the propellant charge. The solvent, if any, must then also be evaporated.

The application of the coatings can be performed before or after the propellant is loaded into a cartridge. If they are to be applied to the propellant already loaded into the cartridge, the lacquer suspension is applied to the still exposed surface of the charge and then the solvent is evaporated. Then the cartridge is crimped shut in the usual manner.

Basically, one can use the charges treated in accordance with the invention without a cartridge. In this case, however, it is necessary to apply the coating of the invention to the entire surface of the charge.

The testing of the propellant charges of the invention for firedamp safety is performed in the manner described above. The gas mixture in the balloon consists of 9 percent methane and 91 percent air, by volume. An air-methane mixture of this composition is the easiest to ignite.

In order to more fully illustrate the nature of the invention and the manner of practicing the same, the following example is presented:

EXAMPLE

A 25 percent solution of polymethyl methacrylate of a molecular weight of 100,000 is prepared in toluene. The same amount of finely powdered polyhydroxymethylene of a molecular weight of 20,000 to 30,000, or of paraformaldehyde, is incorporated into this solution, so as to produce a thick but still barely fluid suspension. Approximately 100 mg of this suspension, corresponding to about 50 mg of dry substance, is applied to the still exposed surface of 200 mg of a nitrocellulose base propellant charge which has previously been loaded into a cartridge approximately 10 mm long with a diameter of about 5 mm.

The solvent is then evaporated until the coating is approximately free of solvent. Then the cartridge is crimped shut. A cartridge prepared in this manner will not ignite an explosive gas mixture. With a cartridge prepared in the same manner, a stud is drive perfectly into construction material, such as wood, for example, with a stud setting machine.

We claim:

1. In a process for driving a stud in a coal mine having a firedamp atmosphere which comprises disposing a stud driving machine in said firedamp atmosphere while in said coal mine, said stud driving machine comprising a cartridge chamber containing a propellant cartridge, said cartridge chamber in facing relationship to a piston or plunger itself in driving relationship at one one end with a stud to be driven in said coal mine, and firing said propellant, the improvement wherein said propellant cartridge consists essentially of a stud driving propellant, said propellant cartridge being coated with a coating material selected from the group consisting of a polymer, an amide of a $C_{2-4}$ dicarboxylic acid and ammonium oxalate, said polymer in turn being selected from the group consisting of a polyacetal, a polyformal, a polyacrylate and a polymethacrylate, which coating material upon ignition of said propellant, disintegrates, said coating being present on said propellant cartridge in an amount of 15 to 30 percent by weight based on the weight of said propellant cartridge, said stud driving propellant comprising nitrocellulose, whereby said propellant is firedamp-safe.

2. A process according to claim 1, wherein said coating material is a polymer.

3. A process according to claim 2, wherein said polymer is a polyformal.

4. A process according to claim 2, wherein said polymer is a polyacetal.

5. A process according to claim 1, wherein said coating material is an amide of a $C_{2-4}$ dicarboxylic acid.

6. A process according to claim 1, wherein said coating material is coated with ammonium oxalate.

7. A process according to claim 1, wherein said propellant cartridge is coated with a polyacetal having a molecular weight of between 1,000 and 50,000.

8. A process according to claim 1, wherein said propellant cartridge is coated on the entire surface thereof with said coating material.

9. A process according to claim 1, wherein said coating material is in the form of a coherent film on the surface of said propellant cartridge.

10. In a process for driving a stud in a coal mine underground which comprises disposing a stud driving machine in said coal mine underground, said stud driving machine comprising a cartridge chamber containing a propellant cartridge, said cartridge chamber in facing relationship to a piston or plunger itself in driving relationship at one end with a stud to be driven in said coal mine, and firing said propellant, the improvement wherein said propellant cartridge consists essentially of a stud driving propellant, said propellant cartridge being coated with a coating material selected from the group consisting of a polymer, an amide of a $C_{2-4}$ dicarboxylic acid and ammonium oxalate, said polymer in turn being selected from the group consisting of a polyacetal, a polyformal, a polyacrylate and a polymethacrylate, which coating material upon ignition of said propellant, disintegrates, said coating being present on said propellant cartridge in an amount of 15 to 30 percent by weight based on the weight of said propellant cartridge, said stud driving propellant comprising nitrocellulose, whereby said propellant is firedamp-safe.

11. A process according to claim 10, wherein said coating material is a polyformal.

12. A process according to claim 10, wherein said polymer is a polyacetal.

13. A process according to claim 10, wherein said coating material is an amide of a $C_{2-4}$ dicarboxylic acid.

14. A process according to claim 10, wherein said coating material is ammonium oxalate.

15. A process according to claim 10, wherein said coating material is a polyacetal having a molecular weight of between 1,000 and 50,000.

16. A process according to claim 10, wherein said propellant cartridge is coated on the entire surface thereof with said coating material.

17. A process according to claim 10, wherein said coating material is in the form of a coherent film on the surface of said propellant cartridge.

* * * * *

UNITED STATES PATENT AND TRADEMARK OFFICE

CERTIFICATE OF CORRECTION

PATENT NO. : 4,453,860

DATED : June 12, 1984

INVENTOR(S) : Heinrich Brachert et al.

It is certified that error appears in the above-identified patent and that said Letters Patent is hereby corrected as shown below:

Column 2, line 50, after "100,000" insert --, --.

Column 2, line 51, after "gel" insert -- permeation --.

Column 3, line 23, after "described" insert -- , --.

Column 3, line 24, after "1806550" insert --, --.

Column 3, line 25 delete "3,468,930" and substitute -- 3,468,730 --.

Column 4, line 7, delete "drive" and substitute -- driven --.

Column 4, line 42, delete "coated with"

Signed and Sealed this

*Twenty-sixth* Day of *March 1985*

[SEAL]

*Attest:*

DONALD J. QUIGG

*Attesting Officer* *Acting Commissioner of Patents and Trademarks*